United States Patent [19]

Childers et al.

[11] Patent Number: 4,940,413

[45] Date of Patent: Jul. 10, 1990

[54] ELECTRICAL MAKE/BREAK INTERCONNECT HAVING HIGH TRACE DENSITY

[75] Inventors: Winthrop D. Childers, San Diego; William Sperry, Poway, both of Calif.

[73] Assignee: Hewlett-Packard Company, Palo Alto, Calif.

[21] Appl. No.: 385,615

[22] Filed: Jul. 26, 1989

[51] Int. Cl.[5] ..... H01R 9/09

[52] U.S. Cl. ..... 439/67; 439/329; 29/846; 346/140 R

[58] Field of Search ..... 29/832, 840, 846, 847, 29/848; 228/180.2; 346/1.1, 76 PH, 140 PD; 361/398, 421; 439/67, 77, 329, 492, 493, 494, 495

[56] References Cited

U.S. PATENT DOCUMENTS

| | | | |
|---|---|---|---|
| 3,716,907 | 2/1973 | Anderson | 228/180.2 X |
| 4,125,310 | 11/1978 | Reardon, II et al. | 439/329 |
| 4,179,802 | 12/1979 | Joshi et al. | 29/847 X |
| 4,602,317 | 7/1986 | Rovnyak et al. | 439/77 X |
| 4,631,555 | 12/1986 | Ikeda et al. | 346/140 PD |
| 4,635,073 | 1/1987 | Hanson | 346/1.1 |
| 4,791,440 | 12/1988 | Eldridge et al. | 346/140 PD |

OTHER PUBLICATIONS

IBM Bulletin, vol. 28, No. 3, Elastomeric Module-to-Board Connector System.

*Primary Examiner*—Neil Abrams
*Assistant Examiner*—Khiem Nguyen
*Attorney, Agent, or Firm*—Roland I. Griffin

[57] ABSTRACT

A pressure make/break interconnect for two sets of coplanar, parallel traces (30 and 46) includes contact pads (50 and 52) on the ends of the one or both sets of traces (30 and 46), the pads (50 and 52) being wider than the spaces between the traces (30 and 46) but staggered so that there is room for the pads (50 and 52) to fit between the traces (30 and 46). One of each facing pair of the traces (30 and 46) or pads (50 and 52) has on its facing surface a bump (66), which serves as the actual contact point and aids in increasing the contacting pressure. An interconnect support (70) behind one of the pads (50 or 52) is configured to aid in intensifying the pressure applied through the bump (66), ensuring good contact. The interconnect support (70) is preferably made of an elastomer and has ridges (74 and 76) on both sides underlying the contact pads (50 and 52), with protrusions (80) on the ridges (74) facing the pads (50 and 52), that extend upwardly to support the contact pads (50 and 52) while the connection is made.

26 Claims, 3 Drawing Sheets

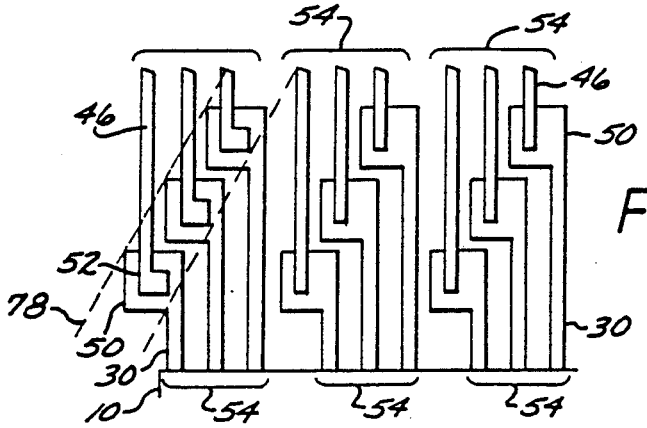
FIG. 5
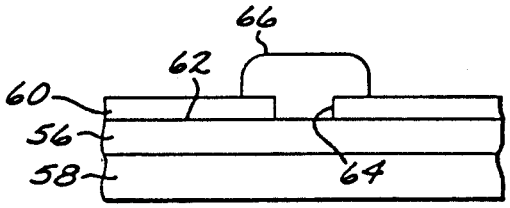
FIG. 6
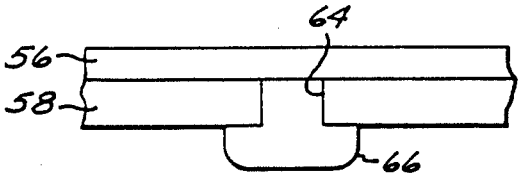
FIG. 7
FIG. 8
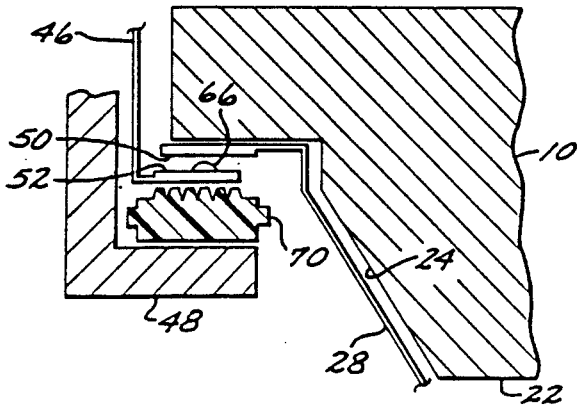

ELECTRICAL MAKE/BREAK INTERCONNECT HAVING HIGH TRACE DENSITY

BACKGROUND OF THE INVENTION

This invention relates to electrical interconnects, and more particularly, to high density electrical make/break interconnects such as used in thermal ink jet printers with replaceable print cartridges.

Printers are devices that print images onto a printing medium such as a sheet of paper. Printers of many types are available, and are commonly linked to a computer that supplies the content of the images, in the form of text, characters, or figures, that are to be printed.

An ink jet printer forms small droplets of a colorant such as an ink or a dye that are ejected toward the printing medium in the pattern that forms the images. Ink jet printers are fast, producing a high output of print, and quiet, because there is no mechanical impact during formation of the image, other than the deposition of the ink onto the medium.

One type of ink jet printer, the thermal ink jet printer, has a large number of individual colorant-ejection nozzles in a print head, oriented in a facing, but spaced-apart, relationship to the printing medium. There is an electrical resistor adjacent each nozzle, and a pulse of current through the resistor causes ejection of a droplet of colorant form the nozzle toward the medium. The print head moves relative to the surface of the medium, with the nozzles ejecting droplets of colorant under command at the proper times. (Alternatively, for a large printing array the print head may be stationary.) The droplets strike the medium and then dry to form "dots" of colorant that, when view together, create the permanently printed image.

Most thermal ink jet printers are constructed with a permanent printer body and a printing means. The printing mechanism includes, preferably, a disposable print head cartridge containing both the colorant ejector and the colorant supply (or, alternatively, a permanent colorant ejector with a disposable colorant supply). The printer body contains the mechanisms to support the printing medium and the print head cartridge in the proper facing relationship so that printing can be accomplished, the power supply that supplies the electrical current to the ejector resistors, the electronic controllers to achieve particular printing functions, and the interface to the computer. The disposable print head cartridge includes the ejector mechanism, its support, and in some cases the colorant supply. There must be a make/break interconnect between the printer body and the disposable print head cartridge, which is a connection that is readily made, is "temporary" in the sense that it is maintained until the cartridge is to be replaced, and allows easy disconnection and replacement. The present invention is concerned with such a make/break interconnect.

The earliest commercial thermal ink jet print heads had a relatively small number of nozzles, typically about 12 nozzles. There is, however, a strong incentive to increase the number of operable nozzles in the print head and to space them very closely together, since the closer the nozzles are to each other the more perfect the appearance of the images. That is, when the nozzles are far apart, the images appear to the eye to be made of a series of dots, but when the nozzles are closely spaced, the dotlike character of the images is not apparent to the eye. It is preferable that the makeup of the image as a collection of dots not be discernible, and that the image appear to be continuous.

The nozzles and related portions of the print head are made by techniques similar to those used in the microelectronics industry, and can be made with very small spacings. However, a practical obstacle to the desired reduction of spacing between the nozzles is the need to transmit appropriate electrical control signals to the resistor for each nozzle. There must be at least one electrical conduction path for each resistor from the power supply in the printer body, into the disposable print head cartridge, and thence to the nozzle. It has been found that, for large numbers of nozzles and required interconnects, and with an essentially constant size of print head, there is simply insufficient room to form all of the make/break interconnections between the disposable cartridge and the printer body.

One approach to this problem of providing a large number of interconnections has been to make each individual interconnection smaller. This approach is limited, however, by manufacturing tolerances and the realization that the replacement of the cartridge is performed by an untrained user of the printer, not a highly trained specialist. The miniaturization of the interconnects cannot be pushed to the point that slight errors made during the replacement procedure cause the printer to become inoperable.

Thus, there is a continuing need for improved ink jet printers wherein larger numbers of nozzles can be provided in a disposable print head cartridge, yet interconnects between the cartridge and the body of the printer can be made easily by the user. The present invention fulfills this need, and further provides related advantages.

SUMMARY OF THE INVENTION

The present invention provides a high density electrical interconnect that enables a large number of traces to be interconnected together in a small space. Thus, in an application such as the print head of an ink jet printer, the number of nozzles on an ejector of constant outside physical dimension may be increased, with a corresponding improvement in the quality of the print.

One embodiment of the invention is directed toward a print head cartridge that may have a larger number of nozzles and a more reliable make/break connection. In accordance with the invention, an article in which two sets of mutually coplanar parallel conductor traces are connected together, and which functins as an ink jet printer component, comprises means for ejecting droplets of colorant toward a printing medium, the means for ejecting including an ejector; and a set of coplanar parallel conductor traces extending from the ejector toward a connection location, each of which traces has a planar enlarged contact pad at its end whose lateral extent is greater than the distance between the traces, the pads being staggered in their distances from the ejector so that there is room for the placement of all of the pads in the plane of the traces.

In another aspect of the invention, the interconnect approach is applied to the printer body. Thus, an article in which two sets of mutually coplanar parallel conductor traces are connected together, and which functions as an ink jet printer component, comprises means for providing electrical pulses to an ejector; and a set of coplanar parallel conductor traces extending from the means for providing toward a connection location, each of which traces has a planar enlarged contact pad at its end whose lateral extent is greater than the distance between the traces, the pads being staggered in their distances from the ejector so that there is room for the placement of all of the pads in the plane of the traces.

More generally, an article in which two sets of mutually coplanar parallel conductor traces are connected together comprises a first set of coplanar parallel conductor traces extending from a device toward an external connection; a second set of coplanar parallel conductor traces extending toward the device from an external connection, and being mutually coplanar with the first set of conductor traces, at least one set of the first and second sets of conductor traces having an enlarged contact pad at the end of each trace, at least some of the pads being spaced at different distances from the device, and the two sets of traces having respective facing surfaces disposed in a facing relationship to each other; and means for releasably contacting the respective facing surfaces together.

The width of individual traces can be made quite small in most circumstances. The challenge in fabricating a device is not in the reduction of trace widths, but in forming a make/break interconnection from the traces of the device, such as the print head cartridge, to a support structure, such as the printer body. In the present approach, enlarged contact pads are provided, preferably at the ends of one set of traces, but optionally at the ends of both of the sets of traces that are to be interconnected. The two sets of traces, and their pads, are configured so that respective facing surfaces are in facing registry when the device is properly assembled to its support structure. The facing surfaces are then pressed together.

The pads, where provided, should be at least about 0.020 inches on a side, to provide a margin of error in assembly. Where pads are provided on both sets of traces, the pads of one set are preferably larger than the pads of the other set, further providing a margin of error when the make/break interconnect is made. If the traces are spaced so closely together that pads of this size are not normally possible due to lack of space, the present invention provides that the locations of the pads are staggered to permit their individual widths to be increased. This staggering of the locations of the pads is readily accomplished with a geometric arrangement wherein the location of each successive pad is further from the device, but such an arrangement can become impractical in its extent. It is therefore preferable to arrange the traces into geometrically similar groupings in which the pads are positioned at increasing distances from the device within each group, with the sequence repeating from group to group.

The corresponding traces or pads of the two sets of traces are releasably held together under pressure, and a preferred approach for attaining a sufficient pressure to ensure a good electrical contact has also been developed. It is desirable to maintain a high contact pressure, to avoid unintentional disconnects and to minimize the effects of possible organic contamination in the contact area. For a fixed available contact force, the contact pressure, used in a technical sense of force divided by area of application of the force, between the two traces may be increased by decreasing the area of the contact. In the present approach, a bump is formed on each of the traces of one of the sets of traces, so that the bump, rather than the entire trace area, contacts the opposing pad when the make/break interconnection is made. When the pad on one side of the interconnection and the trace on the other side are contacted together under an applied force, the bump on the trace contacts the opposing pad, increasing the effective bonding pressure and minimizing the effects of organic contamination.

In accordance with this aspect of the invention, an article in which the facing surfaces of two electrical traces may be releasably connected together comprises a first trace having a facing surface and including a layer of electrically nonconducting material on the facing surface, an aperture through the nonconducting material, and a metallic bump deposited upon the first trace through the aperture; and a second trace having a planar enlarged contact pad at the end of the second trace, the contact pad being disposed in facing relationship to the metallic bump on the first trace. Optionally, the first trace could also have a contact pad at its end, with the bump on the facing surface of the contact pad. In that case, the two sets of contact pads may be of different linear dimensions. The layer of the nonconducting material prevents shorting which might otherwise occur as a result of small misalignments or overlaps of conductors.

An interconnect support may optionally be provided to increase the pressure which holds the pads together, by ensuring that the applied force is properly directed through the interconnect region rather than other areas. The present invention provides an interconnect support having a row of ridges on each side of a central section of the support, the ridges positioned and dimensioned to be disposed below the overlapping ends of the pads and traces to be connected by the make/break connection. On the side of the interconnect support that is facing the underside of the pads (or traces), a row of fingerlike protrusions extends upwardly from the ridge to press against the back side of the pads (or traces) below the bump where pressure is desirably the greatest, and compliantly support them while the interconnect is made. The interconnect support is preferably made of a compliant material such as an elastomer. The compliant elastomer permits the bumps and pads to individually adjust slightly and in position to allow for small misalignments and nonparallelisms that might otherwise interfere with the making of the interconnect. The support also tends to equalize the pressure applied through the various bumps and pads. Thus, the design of the pads, the bump, and the interconnect support cooperate to ensure a reliable make/break interconnect for large numbers of individual traces.

In accordance with a specific aspect of the invention, an article in which two sets of mutually coplanar parallel conductor traces are connected together comprises a first set of coplanar parallel conductor traces extending from a device toward an external connection; a second set of coplanar parallel conductor traces extending toward the device from an external connection, and being mutually coplanar with the first set of conductor traces, at least one set of the first and second sets of conductor traces having an enlarged contact pad at the end of each trace, at least some of the pads being spaced at different distances from the device, and the two sets of traces having respective facing surfaces disposed in a facing relationship to each other; means for releasably contacting the respective facing surfaces together, wherein the means for releasably contacting includes a layer of electrically nonconducting material on the facing surfaces of one of the sets of traces, an aperture through the nonconducting material on each of the traces, and a metallic bump deposited upon the trace through the aperture; and an interconnect support, wherein the interconnect support includes a first series of ridges on a first side of the support and underlying the metallic bumps, a second series of ridges on an opposing side of the support, and a series of protrusions on the ridges that face the metallic bumps, the protrusions extending toward the bumps.

The approach of the invention provides a structure for increasing the number of traces that may be interconnected within a restricted space. The ability to interconnect increased numbers of traces permits a significant improvement in the device to which the traces provide electrical signals, by permitting its capabilities to be increased without an increase in size. Other features and advantages of the invention will be apparent from the following more detailed description of the preferred embodiment, taken in conjunction with the accompanying drawings, which illustrate, by way of example, the principles of the invention.

BRIEF DESCRIPTION OF THE DRAWINGS

FIG. 5 is a plan view of two sets of traces with staggered contact pads;

FIG. 6 is a side elevational view of a trace having a bump deposited thereupon;

FIG. 7 is a side elevational view of another approach for providing a bump on a trace;

FIG. 8 is a side sectional view of a print head cartridge supported in the cartridge support of the printer body, using a make/break interconnection of the invention;

DETAILED DESCRIPTION OF THE PREFERRED EMBODIMENT

Figure 1:
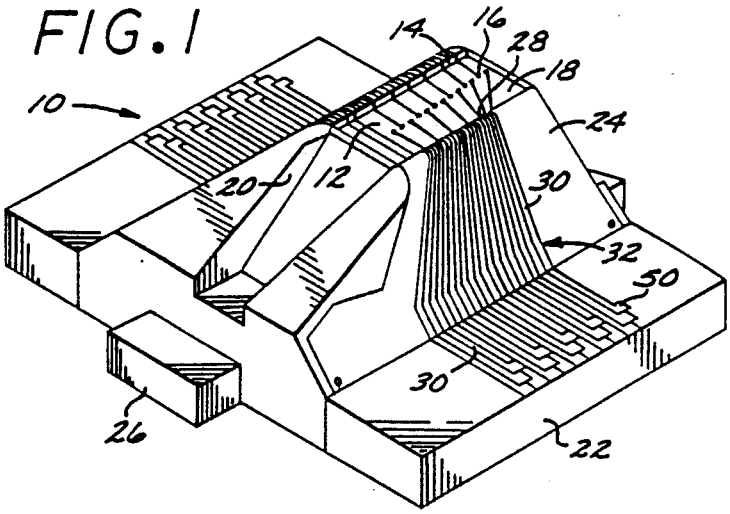
FIG. 1 is a perspective view of a thermal ink jet print head cartridge.

The approach of the present invention is preferably used in conjunction with a thermal ink jet printer, although it is not so restricted. A thermal ink jet print head cartridge 10, used to eject droplets of colorant toward a print medium in a precisely controlled manner, is illustrated in FIG. 1. Such a print head assembly is discussed in more detail in U.S. Pat. No. 4,635,073, whose disclosure is incorporated by reference.

The print head cartridge 10 includes an ejector 12 having a nozzle plate 14. The nozzle plate 14 has a plurality of nozzles 16 therein. Droplets of colorant are ejected from the individual nozzles 16. (As used herein, the term "colorant" means generally a fluid that is deposited upon a printing medium to produce images, which typically includes inks and dyes, and is not restricted to any narrow sense of that term as may be found in the printing arts.)

The ejector 12 is mounted in a recess 18 in the top of the raised portion 20 of a manifold 22. The raised portion 20 has slanted side walls 24, and end tabs 26 which facilitate its handling and attachment to a carriage mechanism in the printer.

Droplets of colorant are ejected from the ejector 12 by passing an electrical current through a resistor (not shown) lying below each nozzle 16. Electrical current is conveyed to the respective electrical resistors through a pluality of leads 28, one for each nozzle 16. External electrical connection to the leads 28 and thence to the resistors is supplied through a set of electrically conducting traces 30, using a flexible interconnect circuit 32. The circuit 32 fits against the side walls 24, with one end extending to the leads 28 and the other end to external connections to a controllable current source that supplies current to the resistors. The general features, structure, and use of such flexible interconnect circuits, and their fabrication, are described in U.S. Pat. No. 3,689,991, whose disclosure is incorporated by reference.

Figure 2:
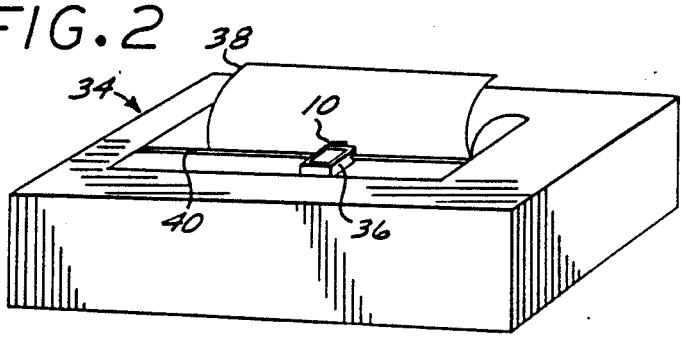
FIG. 2 is a perspective view of an ink jet printer body.

FIG. 2 illustrates a portion of an ink jet printer 34, which can utilize print head cartridges of the type just discussed, and to which the print head cartridge 10 of FIG. 1 is releasably interconnected with a make/break interconnection. The printer 34 supports the print head cartridge 10 in a carriage 36, in a generally facing but spaced apart relationship to a printing medium 38. The carriage moves back and forth over the printing medium 38 on a rail 40.

Figure 3:
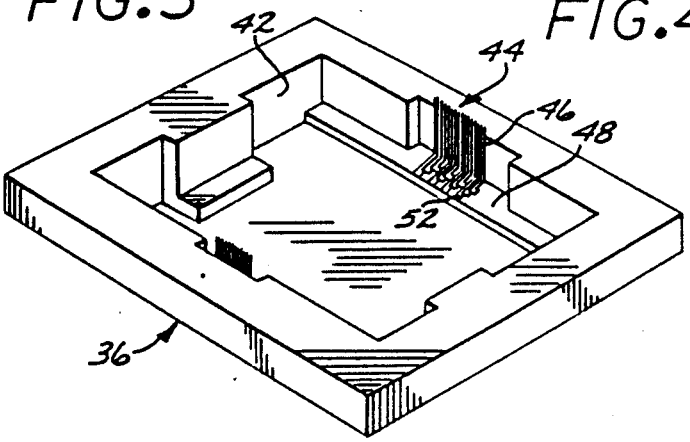
FIG. 3 is a perspective view of the print head cartridge support.

The carriage 36 is illustrated in greater detail in FIG. 3. The carriage includes a pocket 42 into which the cartridge 10 is received in an inverted position, relative to the view of FIG. 1. A cable 44, having a plurality of individual traces 46, runs from a power supply (not shown) in the printer 34 down the side wall of the pocket 42, and to a location where the traces 46 may be releasably connected with a make/break connection to the corresponding traces 30 of the flexible interconnect circuit 32 of the cartridge 10. The traces 46 terminate in contact pads 52 that are supported upon a shelf 48, against which the cartridge 10 rests when it is inserted into the pocket 42.

Figure 4:
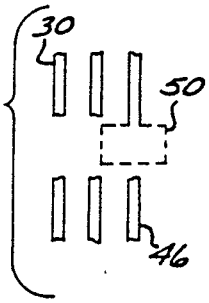
FIG. 4 is a plan view of two sets of planar traces.
Figure 9:
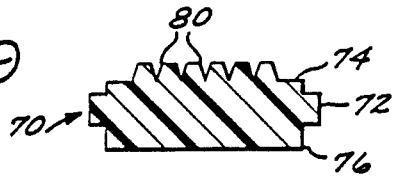
FIG. 9 is a side elevational view of an interconnect support.
Figure 10:
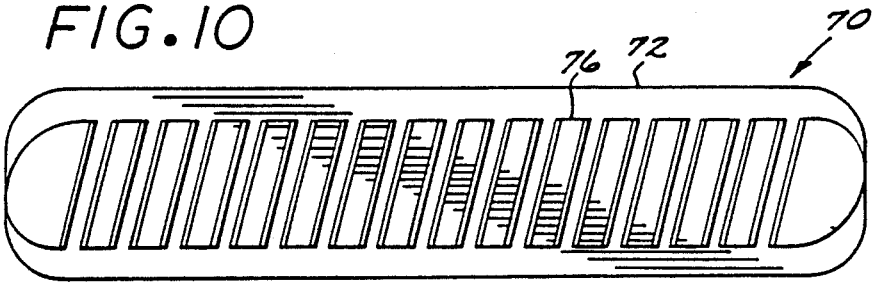
FIG. 10 is a bottom plan view of an interconnect support of FIG. 9.
Figure 11:
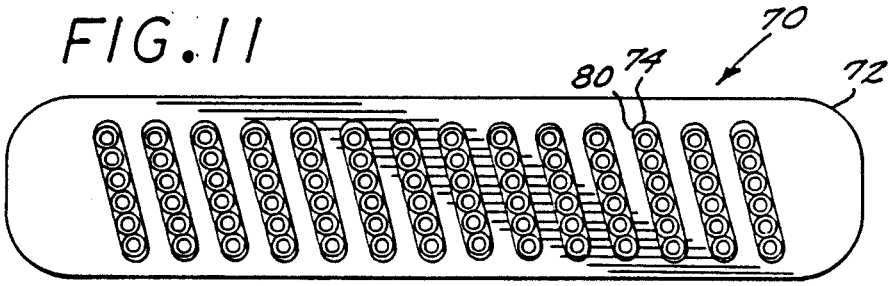
FIG. 11 is a top plan view of the interconnect support of FIG. 9.

FIG. 4 illustrates the problem encountered in attempting to interconnect the set of traces 46 to the set of traces 30. When there are a large number of resistors and thence traces 30 with only a limited space in which to make the interconnect, the traces 46 and 30 are too narrow to reliably connect the traces directly together and maintain alignment. A contact pad 50 shown in dotted lines can be added to the end of each trace of one set of the traces (here shown as the traces 30), so that the pads 50 of the set of traces 30 are more readily aligned with the respective traces 46, thus giving a larger area in which the interconnection can be achieved. However, the space between the adjacent traces of each set is too small to permit the use of the pad 50.

A solution to this problem is illustrated in FIG. 5. Contact pads 50 are provided on the end of each of the traces 30, as part of the cartridge 10, and, optionally, contact pads 52 are provided on the end of each of the traces 46, as part of the printer 34. (Alternatively, the contact pads may be provided on the traces 46 of the printer, and optional contact pads may be provided on the traces 30 of the cartridge.) The pads 50 are positioned to be at different distances from the ejector 12, so that they can be of the minimum width required and still permit the placement of the necessary number of traces. The pads 52, if present, are positioned to be in registry with the pads 50, with their traces 46 extending toward the body of the printer. (One set of traces 46 is shown in FIG. 5 as having planar enlarged contact pads 52, while two sets are shown as not having enlarged contact pads, to illustrate the two different approaches. Normally, all traces of each set either have or do not have enlarged contact pads.) In FIG. 5, the pads 50 and 52 (where present) are shown in their preferred form, wherein the pads of one set (here the pads 52) are smaller than the pads of the other set (here the pads 50). Making the pads of different sizes increases the tolerance for misalignment of the pads and nonregistry introduced as the connection is made. The use of the enlarged pads compensates for such slight nonregistry, permitting the releasable make/break connection to be made, even if the cartridge 10 is not placed into the pocked 42 in exactly the proper position.

As illustrated in FIG. 5, it has been found preferable to arrange the traces and pads into groups 54 that are most conveniently geometrically similar, but wherein the staggering sequence begins anew in each group, and repeats from group to group. Although there is a small amount of lost space as a result of this approach, if only a single grouping is used the bonded array of pads becomes very large and unwieldy in length. Whether to use groups, and if so, the number of traces and pads per group, is determined by the particular circumstances and available space of an application.

It is desirable that the respective pads 50 and traces 46 (or pads 52, where provided) of each set be forced together with a sufficiently high pressure that the interconnection is maintained and that the influence of any resistive organic or other nonconducting material on the facing surfaces be negated. The amount of available force is determined by the total force with which the cartridge 10 is pressed downwardly. The interconnect pressure can therefore be increased by reducing the area of the contact. The reduction of contact area would seem to be contradictory to the increased are of the contact pads 50 and 52, but can be achieved by the following approach. The actual contact area is reduced by supplying a "bump" on one of the contacting faces, preferably of a trace, so that the pad without the bump contacts the relatively small area of the bump, rather than the relatively larger area of contact in the absence of the bump. The use of a bump also reduces the effects of any organic contamination at the bond line and promotes compliance and alignment of the connection without shorting.

An approach for providing the bump on a trace or a pad is illustrated in FIG. 6. In side view, a trace or contact pad 56 (such as the trace 46, the pad 50, or the pad 52), made of a metal such as copper, optionally with gold plating to reduce corrosion, is conventionally supported on a substrate 58, which may be a polymer or some other nonconducting material. A layer 60 is deposited overlying the metallic pad 56 on a facing surface 62, which is the surface that is later to be placed into facing relationship with the opposing trace or contact pad in forming the interconnect. The layer 60 is patterned and provided with an aperture 64 therethrough, down to the trace or contact pad 56, by any appropriate technique. In one suitable and preferred approach, the layer 60 is a photopolymer that may be imaged and developed in the manner well known in the microelectronics art. In other approaches, a laser such as an excimer laser may be used to burn an opening through the layer to form the aperture, the layer can be screen printed with the apertures in place, or openings can be punched or drilled to form the apertures. Whatever the approach used, the result is a plurality of apeartures through the layer and to the traces or pads 56, one aperture per trace or pad and placed in about the center of each trace or pad.

Metal from a plating source is then placed onto the trace or pad 56, using plating techniques well known in the art. The metal cannot plate on the nonconductive layer 60, and instead plates only onto the pad 56 through the aperture 64. The plated metal forms a bump 66, which is of a diameter permitted by the aperture and is enlarged slightly into a mushroom head above the level of the layer 60. The bump 66 is preferably nickel or copper, with a thin placed palladium layer thereon to prevent corrosion. The top of the bump 66 is contacted by the facing pad when the interconnect is formed, as will be described subsequently.

Another approach to providing the bump 66 is illustrated in FIG. 7. In this case, the aperture 64 is formed through the nonconducting substrate 58, and it is not necessary to have the layer 60. The bump 66 is deposited through the aperture in the manner described previously.

The bump 66 may be provided on the facing surface of a trace or a planar enlarged pad. However, it is preferred that the bump be provided on the trace or, if on a pad, the smaller of the pads, if the pads are of different size. There is preferably only one bump per facing pair of two traces, trace and pad, or two pads, so that it is not necessary to align two bumps. That is, there are not two bumps in facing relationship at the interconnect location.

The use of the bumped contact pad increases the pressure at the interconnect location, and the pressure may be increased even further by the use of an interconnect support below the pads to help concentrate the applied contact force into the region of the bump and to ensure compliance. A support has been designed that is operable with the very closely spaced traces possible with the present invention.

An interconnect support 70 is illustrated in several views in FIGS. 8–11. The interconnect support 70 is preferably a single piece of a compliant elastomeric material such as silicone rubber, having a configuration suitable for applying pressure. The support 70 includes a central section 72 having a ridge 74 extending upwardly and a ridge 76 extending downwardly. Each of the ridges 74 and 76 is tapered slightly inwardly from its base on the central section 72 toward its flat top, for lateral rigidity and to permit extrction from a mold during fabrication. The ridges 74 and 76 are positioned to underlie the locations where the traces and/or pads are in facing register, and particularly to underlie the bumps 66. That is, since the pads in any group may be viewed as in a slanted pattern as indicated by the dashed line 78 in FIG. 5, the ridges 74 and 76 are arranged to follow that same slanted pattern.

The ridge 74 extends upwardly in the sense that it extends toward the contacting traces and pads, when the support 70 is placed below the traces and pads in the manner illustrated in FIGS. 8 and 12. A series of protrusions 80 extend further upwardly from the top of the ridge 74. One of the protrusions 80 is disposed under each of the registered pairs of traces, trace and pad, or pads and in particular under each of the bumps 66. The protrusions are slightly tapered inwardly from their bases on the ridge 74 toward their flat upper surface, for rigidity and producibility. The compound structure of upward and downward ridges and upward protrusions permits the manufacture of the support 70 in an elastomer molding operation, and also allows the protrusionns to be relatively short. While in other situations an interconnect support might have only relatively long protrusions under the pads, in the present situation of closely spaced pads it is necessary that the protrusions 80 be relatively short in height. If the protrusions were significantly longer in relation to their widths, they would not have the necessary buckling resistance to support a substantial force and might buckle when the interconnect is made. The result would be an improperly distributed load and too low a pressure to achieve and maintain the interconnection. The short height of the protrusions 80 also permits the protrusions to be compressed when pressure is applied at the time the make/break connection is made.

Figure 12:
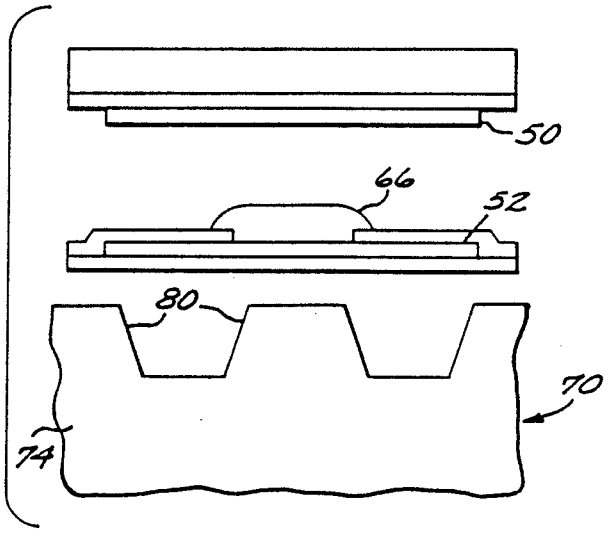
FIG. 12 is a side elevational view of a trace and a contact pad in position to be contacted together.

FIGS. 8 and 12 illustrate the preferred placement of the interconnect support 70, for a case where the traces both terminate in pads. Only one support 70 is used for each pair of pads 50 and 52 in the illustrated embodiment, but two supports could be used. The support 70 may be on either the printer 34 or the cartridge 10, but in the preferred approach is located on the printer side as part of the carriage 36. Thus, the interconnect support 70 sits on the shelf 48. The pad 52 of the trace 46 on the end of the calbe 44 rests on top of the protrusion 80 of the support 70. In the illustrated approach, the bump 66 is on the pad 52, on the printer side of the interconnect. On the cartridge side of the interconnect, the pad 50 is at the end of the trace 30 of the flexible interconnect circuit 32, which is supported by the manifold 22. When the make/break interconnect is made by lowering the print head cartridge 10 into the pocket 42 on the carriage 36 of the printer 34, the respective pads 50 and 52 come into facing contact (with the bump 66 between them), and the make/break interconnection is made. At a later time, the cartridge 10 is removed from the printer 34, and the interconnection is broken. The interconnect support 70 helps to ensure that the interconnect is achieved with a maximum pressure possible from the available interconnect force.

The approach of the invention provides an interconnect structure that permits a high density of electrical leads to extend to a device of small dimension, and for the interconnections to the external circuitry to be accomplished in a confined space. Improved bump and interconnect support structures are presented that permit connection to be accomplished quickly and reliably, and with the proper applied force. This approach permits the maximum misalignment tolerance in a minimum space, an important advantage for advanced printers requiring a high density of electrical interconnections. Although a particular embodiment of the invention has been described in detail for purposes of illustration, various modifications may be made without departing from the spirit and scope of the invention. Accordingly, the invention is not to be limited except as by the appended claims.

What is claimed is:

1. An article in which two sets of mutually coplanar parallel conductor traces are connected together, comprising:

a first set of coplanar parallel conductor traces extending from a device toward an external connection;

a second set of coplanar parallel conductor traces extending toward the device from an external connection, and being mutually coplanar with the first set of conductor traces, at least one set of the first and second sets of conductor traces having an enlarged contact pad at the end of each trace, the width of at least some of the pads being greater than the spacing between the conductor traces, at least some of the pads being spaced at different distances from the device, and the two sets of traces having respective facing surfaces disposed in a facing relationship to each other; and means for releasably contacting the respective facing surfaces together.

2. The article of claim 1, wherein at least one of the sets of conductor traces is supported on a substrate.

3. The article of claim 1, wherein the means for releasably contacting includes:

a raised bump of metal deposited on each of the traces of one of the sets of traces, so as to be positioned between the traces of the first set of traces and the respective facing traces of the second set of traces.

4. The article of claim 1, wherein the means for releasably contacting includes:

a layer of electrically nonconducting material on the facing surface of each trace of one of the sets of traces, an aperture through the nonconducting material on each trace, and a metallic bump deposited upon each trace through the aperture.

5. The article of claim 1, wherein the set of contact pads is arranged in at least two geometrically similar groups.

6. The article of claim 1, further including a compliant interconnect support disposed below the respective facing traces.

7. The article of claim 6, wherein the interconnect support is formed of an elastomer material.

8. The article of claim 6, wherein the interconnect support includes a first series of ridges on one side of the support, underlying and facing toward the traces, a second series of ridges on the other side of the support and underlying the traces, and a series of protrusions on the ridges that face the traces, each protrusion lying under one of the traces and extending toward the trace.

9. The article of claim 1, wherein the lateral width of the contact ads is at least about 0.020 inches.

10. An article in which two sets of mutually coplanar parallel conductor traces are connected together, and which functions as an ink jet printer component, comprising:

means for ejecting droplets of colorant toward a rinting medium, the means for ejecting including an ejector; and a set of coplanar parallel conductor traces extending from the ejector toward a connection location, each of which traces has a planar contact pad at its end whose lateral extent is greater than the distance between the traces, the pads being staggered in their distances from the ejector so that there is room for the placement of all of the pads in the plane of the traces.

11. The article of claim 10, wherein at least some of the contact pads include:

a raised bump of metal deposited on at least one face of the contact pad.

12. The article of claim 10, wherein at least some of the contact pads include:

a layer of electrically nonconducting material on a facing surface of the contact pads, an aperture through the nonconducting material on each contact pad, and a metallic bump deposited upon each contact pad through the aperture.

13. The article of claim 10, wherein the set of contact pads is arranged in at least two geometrically similar groups.

14. The article of claim 10, further including a compliant interconnect support disposed below the contact pads.

15. The article of claim 14, wherein the interconnect support is formed of an elastomer material.

16. The article of claim 15, wherein the interconnect support includes a series of ridges on one side of the support and underlying the contact pads, a second series of ridges on the other side of the support and underlying the contact pads, and a series of protrusions on the ridge that faces the contact pads, the protrusions extending toward the pads.

17. The article of claim 10, wherein the lateral extent of the contact pads is at least about 0.020 inches.

18. An article in which two sets of mutually coplanar parallel conductor traces are connected together, and which functions as an ink jet printer component, comprising:

means for providing electrical pulses to an ejector; and a set of coplanar parallel conductor traces extending from the means for providing toward a connection location, each of which traces has a planar enlarged contact pad at its end whose lateral extent is greater than the distance between the traces, the pads being staggered in their distances from the ejector so that there is room for the placement of all of the pads in the plane of the traces.

19. The article of claim 18, wherein at least some of the contact pads include:

a raised bump of metal deposited on at least one face of the contact pad.

20. The article of claim 18, wherein at least some of the contact pads include:

a layer of electrically nonconducting material on a facing surface of the contact pads, an aperture through the nonconducting material on each contact pad, and a metallic bump deposited upon each contact pad through the aperture.

21. The article of claim 18, wherein the set of contact pads is arranged in at least two geometrically similar groups.

22. The article of claim 18, further including a compliant interconnect support disposed below the contact pads.

23. The article of claim 22, wherein the interconnect support is formed of an elastomer material.

24. The article of claim 22, wherein the interconnect support includes a series of ridges on one side of the support and underlying the contact pads, a second series of ridges on the other side of the support and underlying the contact pads, and a series of protrusions on the ridge that faces the contact pads, the protrusions extending toward the pads.

25. An article in which two sets of mutually.coplanar parallel conductor traces are connected together, comprising:

a first set of coplanar parallel conductor traces extending from a device toward an external connection;

a second set of coplanar parallel conductor traces extending toward the device from an external connection, and being mutually coplanar with the first set of conductor traces, at least one set of the first and second sets of conductor traces having an enlarged contact pad at the end of each trace, at least some of the pads being spaced at different distances from the device, and the two sets of traces having respective facing surfaces disposed in a facing relationship to each other;

means for releasably contacting the respective facing surfaces together, wherein the means for releasably contacting includes a layer of electrically nonconducting material on the facing surfaces of one of the sets of traces, an aperture through the nonconducting material on each of the traces, and a metallic bump deposited upon the trace through the aperture; and an interconnect support, wherein the interconnect support includes a first series of ridges on a first side of the support and underlying the metallic bumps, a second series of ridges on an opposing side of the support, and a series of protrusions on the ridges that face the metallic bumps, the protrusions extending toward the bumps.

26. An article in which the facing surfaces of two electrical traces may be releasably connected together, comprising:

a first trace having a facing surface and including a layer of electrically nonconducting material on the facing surface, an aperture through the nonconducting material, and a metallic bump deposited upon the first trace through the aperture;

a second trace having a planar enlarged contact pad at the end of the second trace, the contact pad being disposed in facing relationship to the metallic bump on the first trace; and a compliant interconnect support disposed below the facing portions of the traces, wherein the interconnect support is formed of an elastomer material, the support including a first series of ridges on one side of the support, underlying and facing the bumps, a second series of ridges on the other side of the support, and a series of protrusions on the first series of ridges, the protrusions underlying the bumps.

* * * * *